US009434078B2

(12) United States Patent
Julemont

(10) Patent No.: US 9,434,078 B2
(45) Date of Patent: Sep. 6, 2016

(54) COMB FOR CLIPPERS

(75) Inventor: Pierre Julemont, Soumagne (BE)

(73) Assignee: Babyliss Faco SPRL, Liege (BE)

( * ) Notice: Subject to any disclaimer, the term of this patent is extended or adjusted under 35 U.S.C. 154(b) by 206 days.

(21) Appl. No.: 14/127,360

(22) PCT Filed: Jun. 20, 2012

(86) PCT No.: PCT/EP2012/061814
§ 371 (c)(1),
(2), (4) Date: Mar. 28, 2014

(87) PCT Pub. No.: WO2012/175549
PCT Pub. Date: Dec. 27, 2012

(65) Prior Publication Data

US 2014/0215832 A1 Aug. 7, 2014

(30) Foreign Application Priority Data

Jun. 24, 2011 (EP) ..... 11171273

(51) Int. Cl.
*B26B 19/20* (2006.01)
*B26B 19/38* (2006.01)
*A45D 24/36* (2006.01)

(52) U.S. Cl.
CPC ..... *B26B 19/20* (2013.01); *A45D 24/36* (2013.01); *B26B 19/3813* (2013.01)

(58) Field of Classification Search
CPC .... A45D 24/36; B26B 19/20; B26B 19/3813
See application file for complete search history.

(56) References Cited

U.S. PATENT DOCUMENTS 1,628,421 A * 5/1927 Patenaude ..... B26B 19/20 30/200
1,957,430 A * 5/1934 Giorgi Adelmo ..... B26B 19/20 30/200
1,964,019 A 6/1934 Adelmo
2,320,807 A * 6/1943 Upham ..... B26B 19/38 132/143
2,381,046 A 8/1945 Giorgi
3,149,418 A * 9/1964 Milbourne ..... B26B 19/20 30/201
3,177,582 A * 4/1965 Curtis ..... B26B 21/40 30/540
3,277,571 A * 10/1966 Bloomfield ..... B26B 29/00 30/540
3,388,468 A * 6/1968 Hamill ..... B26B 21/40 30/540
3,530,574 A * 9/1970 Patterson ..... B26B 21/40 30/540
3,648,370 A * 3/1972 Cercone ..... B26B 19/20 30/201
3,844,036 A * 10/1974 Wahl ..... B26B 19/24 30/200
3,969,819 A * 7/1976 Pepera ..... B26B 19/20 30/200
4,614,036 A 9/1986 Haraguchi (Continued)

FOREIGN PATENT DOCUMENTS

CA 2254672 A1 6/1999

*Primary Examiner* — Hwei C Payer
(74) *Attorney, Agent, or Firm* — Reinhart Boerner Van Deuren P.C.

(57) ABSTRACT

The present invention relates to a removable comb (1) having a latch (5) enabling the comb (1) to be attached to clippers (6) during use, the latch (5) being positioned on an arch (3), the curvature of which increases when pressure is applied to the sides of the arch, the increase in curvature of the arch (3) leading to the unlatching of the comb (1).

9 Claims, 5 Drawing Sheets

(56) References Cited

U.S. PATENT DOCUMENTS

| | | | | |
|---|---|---|---|---|
| 5,050,305 | A | 9/1991 | Baker et al. | |
| 5,937,526 | A * | 8/1999 | Wahl | B26B 19/20 30/200 |
| 6,079,103 | A * | 6/2000 | Melton | B26B 19/20 30/43.92 |
| 6,807,736 | B2 * | 10/2004 | Langley | B26B 19/20 30/123 |
| 7,536,789 | B2 * | 5/2009 | Michel | A45D 24/22 30/200 |
| 8,844,142 | B2 * | 9/2014 | Kammer | B26B 19/3846 30/201 |
| 2008/0184565 | A1 | 8/2008 | Zoot et al. | |
| 2009/0113722 | A1 * | 5/2009 | Werner | B26B 19/3813 30/200 |
| 2011/0219620 | A1 * | 9/2011 | Rehbein | B26B 19/3813 30/34.1 |
| 2014/0215832 | A1 * | 8/2014 | Julemont | B26B 19/20 30/200 |

* cited by examiner

COMB FOR CLIPPERS

FIELD OF THE INVENTION

The present invention relates to a removable comb intended to be attached onto a hair or beard clipper, and more particularly to a comb comprising improved attachment means that makes changing the comb of the clipper easier.

STATE OF THE ART

The clipper comb, also called cutting guide, is used for adjusting the cutting height for the hair or the hairs of a beard. Some existing cutting guides are firmly attached to the clipper, whose position can be adjusted by means of a control member that may be motor-driven. Moreover, there are removable combs of different sizes intended to be attached onto the head of the clipper by the user in order to adapt the cutting height.

In the latter case, many systems for locking the comb to the clipper are known. The comb may either be attached to the inside or to the outside of the clipper's head. Outer attachment systems are disclosed inter alia in patent applications CA 2,254,672 A1 and US 2008/0184565 A1, as well as in U.S. Pat. No. 4,614,036.

Patent applications CA 2,254,672 A1 and US 2008/0184565 A1 show a comb that comprises at one end a flexible tab ensuring attachment onto the clipper's blade.

In U.S. Pat. No. 4,614,036, the comb is attached onto the clipper by means of a flexible tab positioned at the base of the comb and comprising a hook that may be engaged into one of the grooves found on the casing of the clipper.

The locking systems of the state of the art require direct handling of the tab in order to allow unlocking of the comb/clipper assembly. Now, it is not always easy to manipulate the lock either because it is not easy to access or because of the effort required for managing to unblock the system with the result that the user might break a nail.

AIMS OF THE INVENTION

The present invention aims to provide a comb equipped with attachment means that do not have the drawbacks of the state of the art.

It thus aims to produce a comb equipped with easily accessible attachment means that do not require direct handling of the latch and only require a small effort from the user.

MAIN CHARACTERISTIC ELEMENTS OF THE INVENTION

The present invention relates to a removable comb comprising a latch allowing, in use, to attach said comb onto a clipper, said latch being positioned on an arc, whose curvature increases when pressure is applied to the sides of the arc, the increase in curvature of the arc causing the unlocking of the comb.

According to particular embodiments of the invention, the comb comprises at least one or a suitable combination of the following characteristics:

- the latch is positioned in the middle of the arc;
- the latch comprises a protrusion cooperating with a complementary portion on the clipper;
- said complementary portion is a fixed blade of the clipper or an adapter to be attached on the clipper;

- the comb is a one-piece comb;
- it comprises teeth with a set height comprised between 3 and 25 mm;
- the arc is configured so that its deflection increases by a distance from 0.2 to 10 mm, preferably from 0.5 to 3 mm.

The present invention also relates to a clipper comprising a comb as described above.

SHORT DESCRIPTION OF THE FIGURES

Figure 8:
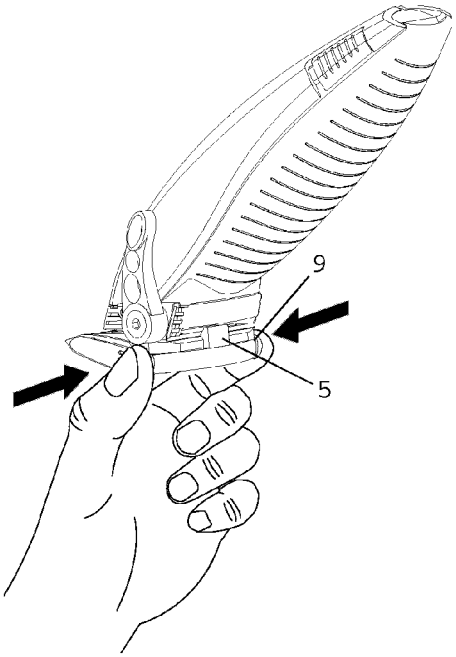
Figure 9:
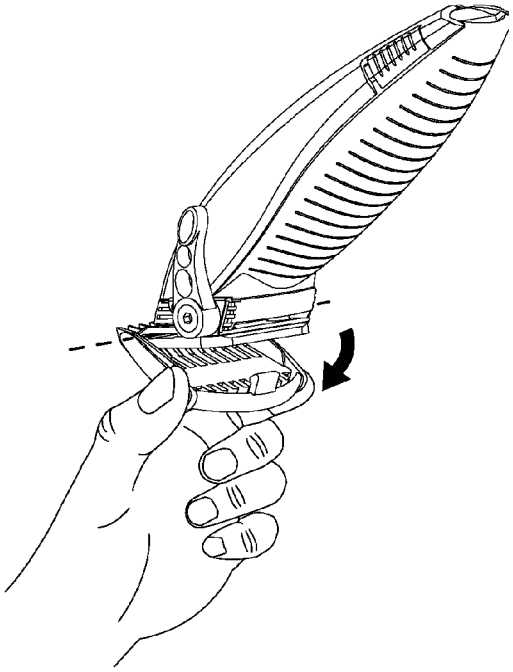
Figure 10:
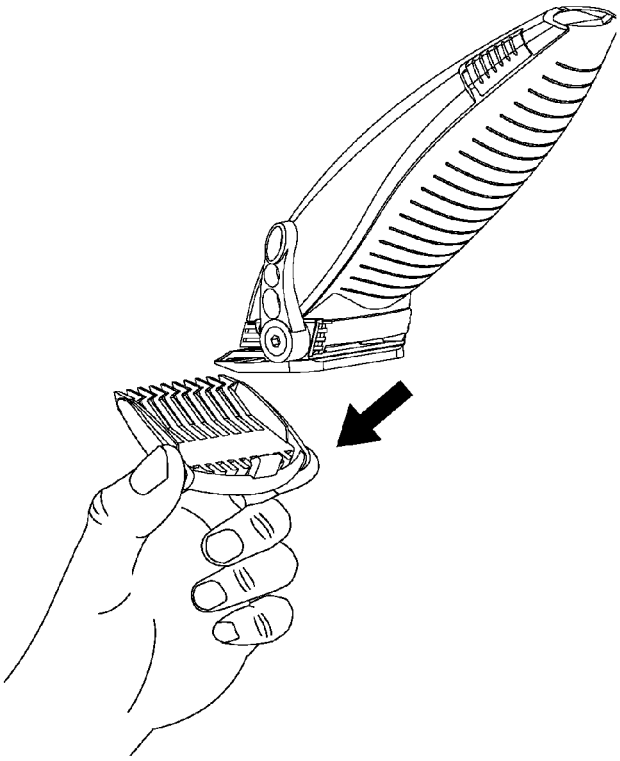

FIGS. 8, 9 and 10 respectively illustrate three-dimensional views of the successive actions to be performed by the user for detaching the comb from the clipper. As an example, the actions are illustrated for the comb as in the invention that is attached onto the fixed blade of the clipper (without any adapter). The arrows indicate the sides of the arc that are pressed for increasing the curvature thereof, allowing to unlock the comb.

KEY (1) Comb
(2) Comb tooth
(3) Curved portion, also called arc
(4) Side of the arc with lateral bearing surface
(5) Latch
(6) Clipper
(7) Tab
(8) Protrusion
(9) Fixed blade
(10) Attachment edge
(11) Opening
(12) Adapter

DETAILED DESCRIPTION OF THE INVENTION

The present invention relates to a removable comb for a clipper, and more particularly to the means for attaching said comb to the clipper. The clipper may be a beard or hair clipper or be intended for animal use.

Figure 1:
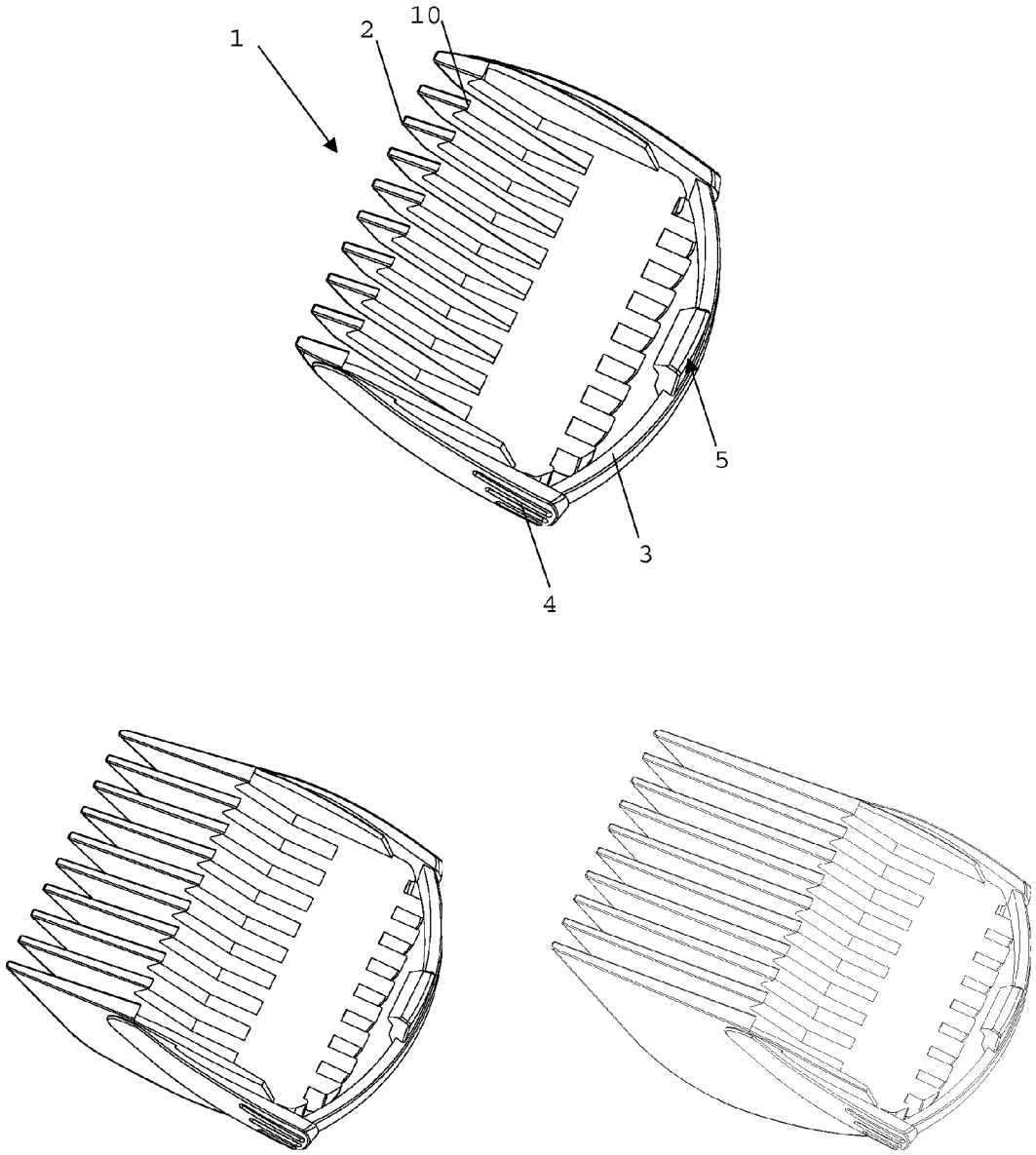
FIG. 1 illustrates three-dimensional views of combs as in the invention for three different cutting heights (3, 13 and 25 mm).
Figure 2:
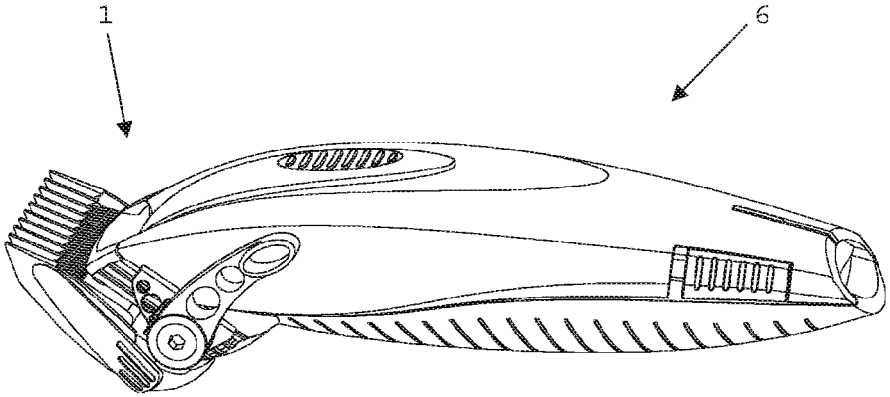
FIG. 2 illustrates a three-dimensional view of the comb/clipper assembly comprising the comb as in the invention.
Figure 3:
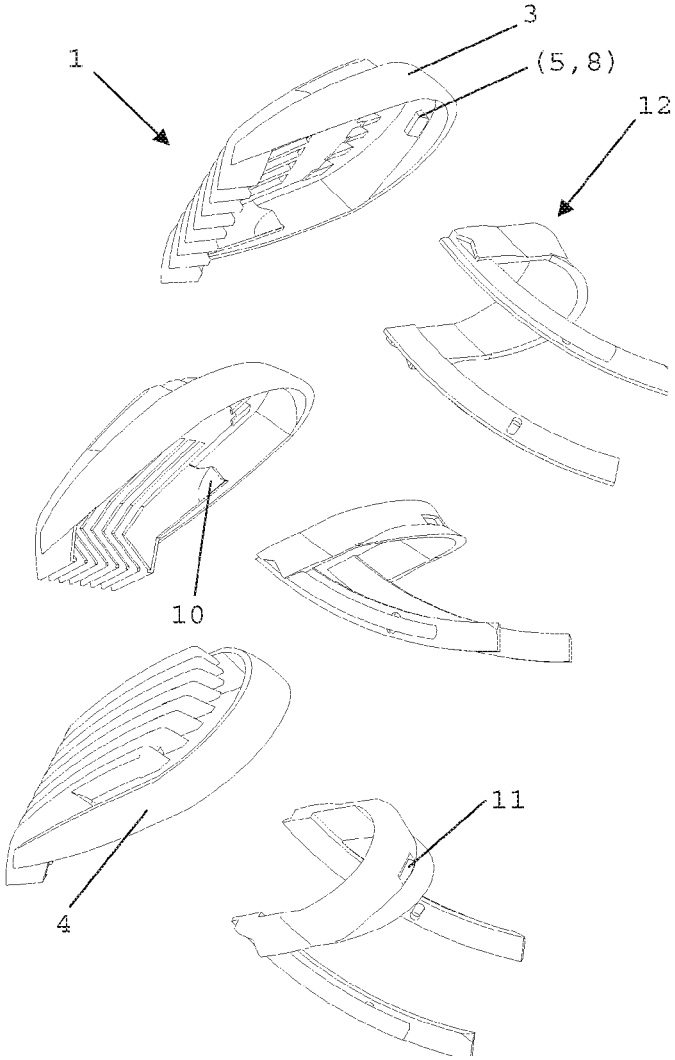
FIG. 3 illustrates three-dimensional views of the comb as in the invention intended to be attached onto a removable adapter.

The comb 1 as in the invention is illustrated in FIGS. 1 and 3 for different cutting heights. It is provided with teeth 2 on its face intended to be put into contact with the skin. On the opposite side, it comprises an arc-shaped flexible curved portion 3 that is preferably made in a plastic material integral with the whole of the comb (one-piece structure).

The arc 3 comprises two lateral bearing surfaces 4 intended to be pinched by the user upon unlocking the comb/clipper assembly. The lateral bearing surfaces may equally be comprised in the continuity of the arc as in FIG. 3 or form distinctive surfaces of the arc with, for example, a raised portion or grooves as in FIG. 1.

Figure 4:
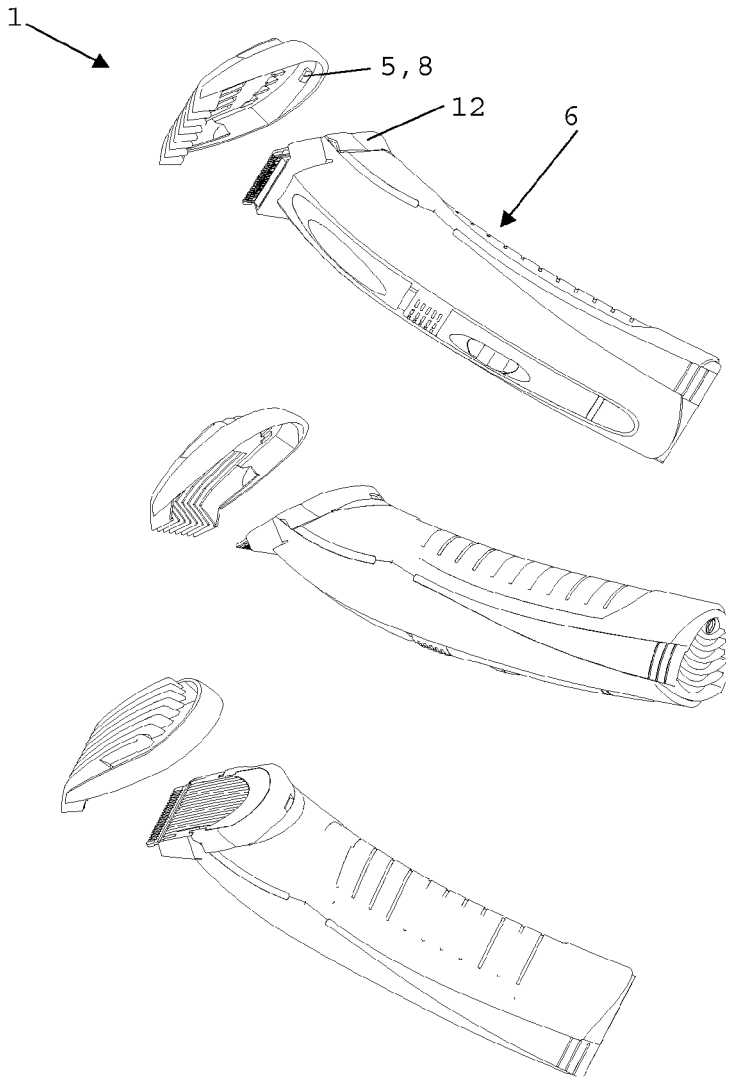
FIG. 4 illustrates three-dimensional views of the comb of FIG. 3 and of the clipper comprising the aforementioned adapter.
Figure 7:
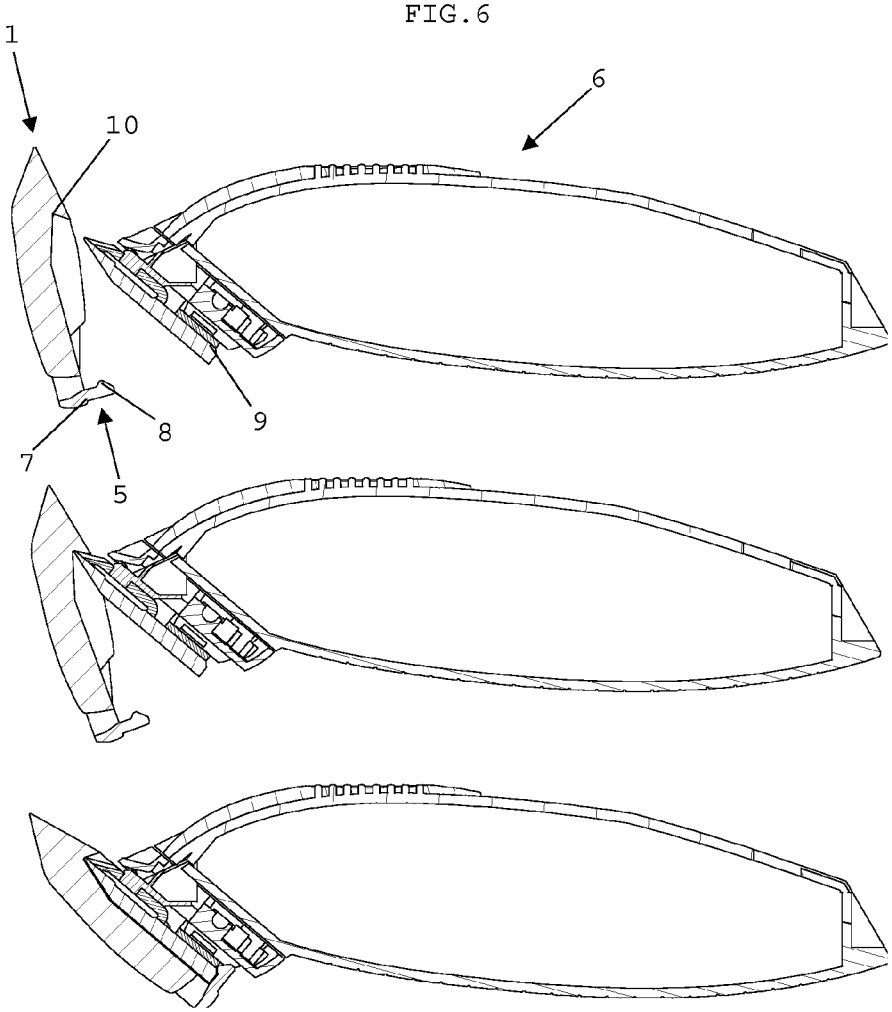
FIG. 7 illustrates sectional views of how the comb as in the invention is attached onto the clipper (without any adapter).

The arc 3 comprises a latch 5 ensuring the attachment of the comb 1 onto the clipper 6 (see FIGS. 4 and 7). More specifically, the latch ensures the attachment of the comb onto the fixed blade 9 of the clipper as illustrated in FIG. 7 or onto an adapter 12 that may be removably mounted on the clipper as shown in FIGS. 3 and 4.

The latch 5 is positioned in the middle of the arc and it comprises a protrusion 8 cooperating with the fixed blade 9 or with the adapter 12. The protrusion 8 may be positioned at the top of a tab 7 rising from the arc 3 in a direction that is substantially perpendicular to the plane formed by the lateral bearing surfaces 4 and the arc (see FIGS. 1 and 7). This protrusion 8 will grip the fixed blade 9 of the comb upon locking the comb on the clipper. The protrusion 8 may also be positioned on the arc 3 and be housed upon locking in an opening 11 provided in the adapter 12 (see FIG. 3).

Figure 6:
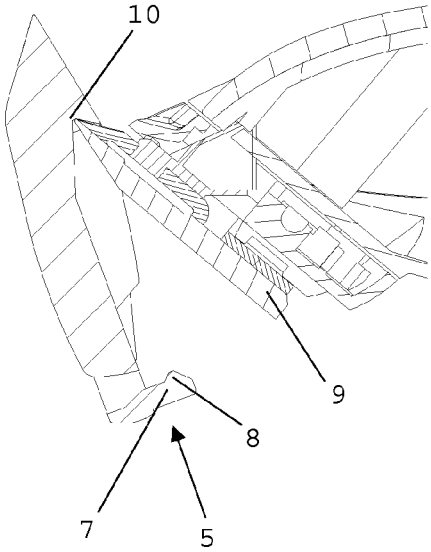
FIG. 6 illustrates a sectional view of the attachment of the comb as in the invention onto the head of the clipper blade (without any adapter).

At least one of the teeth 2 of the combs comprises an attachment edge 10 positioned inside the tooth. As illustrated in FIGS. 4 and 6, the attachment edges 10 are configured for attaching the head of the fixed blade of the clipper. The attachment edges 10 may also allow attachment to the adapter 12, which is itself provided with attachment means 10 (see FIG. 3).

Figure 5:
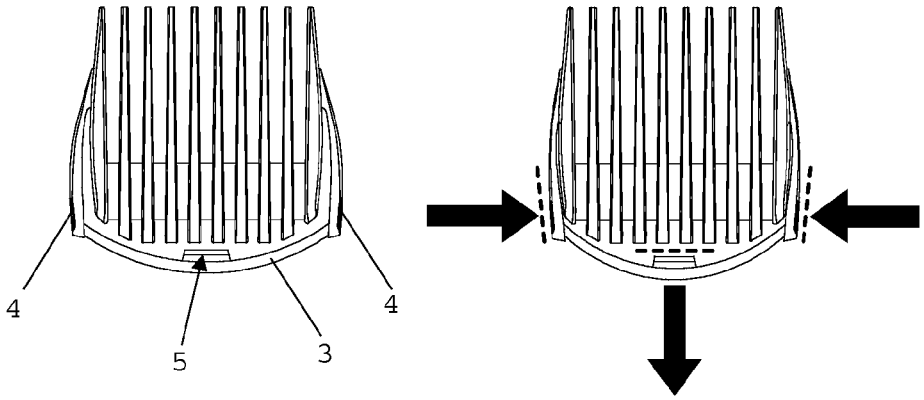
FIG. 5 illustrates by means of arrows the areas of the comb that are urged and deformed during the unlocking of the comb.

During use, upon unlocking of the comb/clipper assembly, the user will pinch the lateral bearing surfaces 4 of the comb as illustrated in FIGS. 5 and 10, which results in that the deflection of the arc 3 significantly increases by a distance of the order of 0.2 to 10 mm, preferably from 0.5 to 3 mm. Thus, during the unlocking operation illustrated in FIGS. 8-10, the latch 5 is detached from the fixed blade 9 or from the adapter if the clipper is provided with an adapter. The user then only has to remove the comb from the head of the blade.

ADVANTAGES OF THE COMB AS IN THE INVENTION

The comb may be made at a low cost due to its one-piece structure.

The comb may be easily detached from the clipper by the user. Thus, unlocking is carried out indirectly by means of the lateral bearing surfaces and consequently does not require any manipulation of the latch as such.

The invention claimed is:

1. A removable comb (1) comprising a plurality of comb teeth (2), an arc (3) opposite the comb teeth (2), and a latch (5) allowing, in use, for attachment of said comb (1) onto a clipper (6), said latch (5) being positioned on said arc (3), the curvature of the arc (3) increases when pressure is applied on opposing sides of the arc (3), the increase in the curvature of the arc (3) causing the latch (5) to unlatch from the clipper (6).

2. The comb (1) as in claim 1, wherein the latch (5) is positioned in the middle of the arc (3).

3. The comb (1) as in claim 1, wherein the latch (5) comprises a protrusion (8) capable of cooperating with a complementary portion on the clipper (6) when in use.

4. The comb (1) as in claim 1, wherein the comb (1) is a one-piece comb.

5. The comb (1) as in claim 1, wherein said a plurality of comb teeth (2) comprises a set height of between 3 and 25 mm.

6. The comb (1) as in claim 1, wherein the arc (3) is configured so that its deflection increases from 0.2 to 10 mm.

7. A clipper (6) comprising a comb (1) as in claim 1.

8. The clipper (6) of claim 7, wherein the latch (5) of the comb (1) comprises a protrusion (8) cooperating with a complementary portion on the clipper (6), and wherein said complementary portion is a fixed blade (9) of the clipper (16) or an adapter (12) to be attached onto the clipper (6).

9. The comb (1) as in claim 7, wherein the arc (3) is configured so that its deflection increases from 0.5 to 3 mm.

* * * * *